US007267601B2

(12) United States Patent
Horie et al.

(10) Patent No.: US 7,267,601 B2
(45) Date of Patent: Sep. 11, 2007

(54) METHOD OF PRODUCING POLISHING CLOTH

(75) Inventors: Yuji Horie, Tokyo (JP); Hiromitsu Okuyama, Tokyo (JP); Kazuei Yamaguchi, Tokyo (JP)

(73) Assignee: NIHON Micro Coating Co., Ltd., Tokyo (JP)

( * ) Notice: Subject to any disclaimer, the term of this patent is extended or adjusted under 35 U.S.C. 154(b) by 0 days.

(21) Appl. No.: 11/501,493

(22) Filed: Aug. 8, 2006

(65) Prior Publication Data

US 2006/0270328 A1 Nov. 30, 2006

Related U.S. Application Data

(62) Division of application No. 10/666,987, filed on Sep. 19, 2003, now Pat. No. 7,134,952.

(51) Int. Cl.
*B32B 3/10* (2006.01)
*B24D 11/00* (2006.01)
*B24B 1/00* (2006.01)

(52) U.S. Cl. ..... 451/28; 428/116; 428/136; 451/533; 451/527

(58) Field of Classification Search ..... 428/116, 428/134, 136, 409; 451/28, 526, 527, 529, 451/533, 534, 550
See application file for complete search history.

(56) References Cited

U.S. PATENT DOCUMENTS

| | | | | |
|---|---|---|---|---|
| 3,137,611 | A * | 6/1964 | Krolik, Jr. | 428/131 |
| 3,707,401 | A * | 12/1972 | Jarema et al. | 428/312.2 |
| 3,976,525 | A * | 8/1976 | Mednick | 156/72 |
| 3,983,287 | A * | 9/1976 | Goossen et al. | 442/226 |
| 4,714,644 | A * | 12/1987 | Rich | 428/136 |
| 6,929,538 | B2 | 8/2005 | Schutz | |
| 6,929,539 | B2 * | 8/2005 | Schutz et al. | 451/534 |
| 2003/0150169 | A1 * | 8/2003 | Annen | 51/300 |

* cited by examiner

*Primary Examiner*—Timothy V. Eley
(74) *Attorney, Agent, or Firm*—Beyer Weaver LLP

(57) ABSTRACT

A polishing cloth to be produced has a surface layer stacked over a base material. The surface layer is made of a foamed layer and a non-foamed layer, the foamed layer including air bubble cells and the non-foamed layer having an externally exposed surface where linear cuts are formed. These linear cuts reach the air bubble cells such that the air bubble cells communicate with the exterior through the linear cuts. These linear cuts are controlled to be 10 μm or less in length. Such a polishing cloth is produced by applying a foamable coating material such as a foamable resin over a surface of the base material, foaming the foamable coating material to form the surface layer, and forming the linear cuts through the non-foamed layer.

2 Claims, 3 Drawing Sheets

METHOD OF PRODUCING POLISHING CLOTH

This is a divisional of application Ser. No. 10/666,987 filed Sep. 19, 2003, now U.S. Pat. No. 7,134,952.

BACKGROUND OF THE INVENTION

This invention relates to a method of producing polishing cloth and more particularly a polishing cloth suited to the final polishing of hard disk substrates and silicon wafers.

It has been known to use a polishing cloth of the type produced by removing the non-foamed layer (referred to as the skin layer) which constitutes a surface portion of the foamed layer by buffing or by means of a knife so as to expose air bubble cells generated inside the foamed layer on the surface by 1-1000 μm. This was both because it is necessary to hold the polishing liquid in the air bubble cells and because the surface of a foamed resin material normally produced is not sufficiently smooth and flat. Surface roughness due to air bubble cells affects the surface flatness adversely, and it is becoming a serious problem because surface roughness results on surfaces polished by such a polishing cloth. The problem of surface roughness is recently becoming particularly important in the technical field of final polishing of hard disk substrates and silicon wafers and it is becoming essential to reduce such surface roughness.

In view of the problem of reducing surface roughness, Japanese Patent 3,187,769 disclosed the technology of using sandpaper or the like with fine particles to buff the surface of a polishing cloth after air bubbles are exposed, and Japanese Patent Publication Tokkai 2001-62704 disclosed the technology of minutely buffing the skin layer without exposing air bubbles on the surface to improve surface flatness. The former technology is not satisfactory because the surface flatness cannot be improved over a certain limit because air bubbles are exposed on the polishing surface. Neither is the latter technology satisfactory but it is because the polishing liquid cannot be retained.

SUMMARY OF THE INVENTION

It is therefore an object of this invention, in view of the failure of the prior art technologies to properly address the aforementioned problem, to provide a method of producing polishing cloth with an improved surface flatness, capable of retaining a polishing liquid.

A polishing cloth to be produced by a method of this invention may be characterized as comprising a base material and a surface layer stacked over the base material, the surface layer comprising a foamed layer and a non-foamed layer, the foamed layer including air bubble cells and the non-foamed layer having an externally exposed surface where linear cuts are formed so as to reach the air bubble cells such that the air bubble cells communicate with the exterior through the linear cuts. These linear cuts are controlled to be 10 μm or less in length. The base material may comprise any one selected from resin materials such as polyethylene terephthalate, vinyl polychloride and cellophane, rubber materials, paper materials, cloth materials such as a woven cloth and an unwoven cloth, metal materials and foamed materials. The surface layer comprises foamed polyurethane resin and may have unevenness produced by a gravure process or an embossing work process.

A method embodying this invention for producing such a polishing cloth may be characterized as comprising the steps of applying a foamable coating material comprising a foamable resin over a surface of the base material, foaming the foamable coating material to thereby form the surface layer, and forming the linear cuts through the non-foamed layer. These linear cuts are formed by a buffing process so as to be 10 μm or less in length.

If a polishing cloth of this invention is used, not only can waviness, or surface roughness, of a polished product be significantly improved but damages due to the polishing process can also be reduced. Such polishing cloths can be produced by a method embodying this invention at a reduced production cost at an improved throughput without requiring any additional equipment or space for such a new equipment.

BRIEF DESCRIPTION OF THE DRAWINGS

FIGS. 2A-1 and 2A-2 are enlarged photographs respectively of a sectional view and a plan view of a polishing cloth of this invention and FIGS. 2B-1 and 2B-2 are enlarged photographs respectively of a sectional view and a plan view of a prior art polishing cloth.

DETAILED DESCRIPTION OF THE INVENTION

Figure 1:
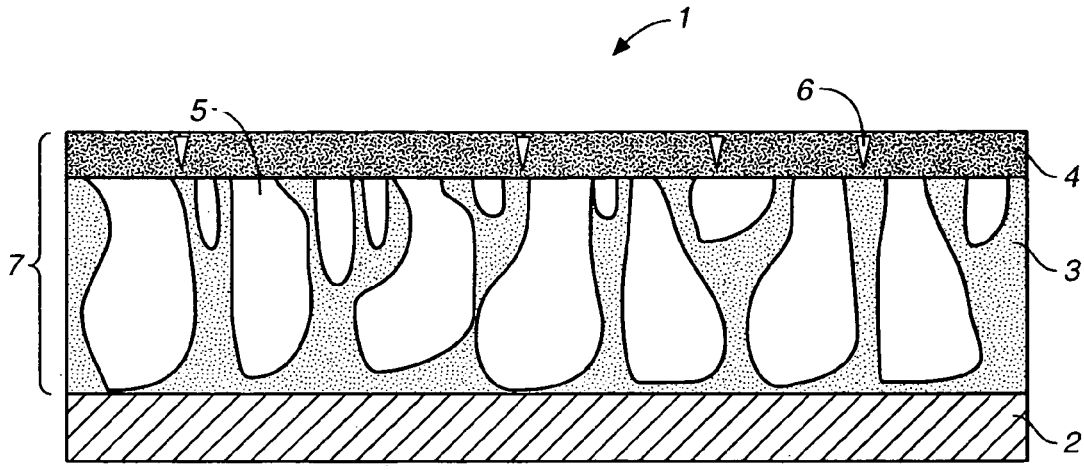
FIG. 1 is a schematic sectional view of an example of polishing cloth produced by a method of this invention.

The invention is described next in detail with reference to the drawings. FIG. 1 shows a polishing cloth 1 to be produced by a method embodying this invention, comprising a base layer 2 and a surface layer 7 which is stacked on the surface of the base layer 2. The base layer 2 is made of any of resin materials such as polyethylene terephthalate (PET), vinyl chloride and cellophane, rubber, paper, a cloth material such as a woven cloth or a non-woven cloth, a metallic material or a foamed material. The surface layer 7 is made of foamed polyurethane resin and includes both a foamed layer 3 and a skin layer 4. The foamed layer 3 contains a large number of air bubble cells 5 inside. The skin layer 4 is formed when foaming urethane resin is foamed and its surface is extremely flat and smooth. Linear cuts 6, which characterize this invention, are formed on the surface of the skin layer 4. Linear cuts 6 are essentially elongated grooves. The depth of these linear cuts 6 is such that they completely penetrate the skin layer 4. Their lengths are preferably controlled to be 10 μm or less. Some of the linear cuts 6 which completely penetrate the skin layer 4 reach and open to an air bubble cell 5. These linear cuts 6 serve to retain a polishing liquid and to take in debris and impurities during a polishing operation. The linear cuts 6 also serve to allow the gas remaining within the air bubble cells 5 to escape and to be discharged therethrough to the exterior. The shape, length and depth of the linear cuts 6 may be selected according to the characteristics of the polishing liquid to be used such as the diameter of the abrading particles contained therein or its viscosity. The linear cuts 6 may be formed either continuously or intermittently.

As a variation, the surface of the skin layer 4 may be made uneven by gravure or embossing finish process. This may serve to reduce the frictional resistance.

Figures 1, 2A:
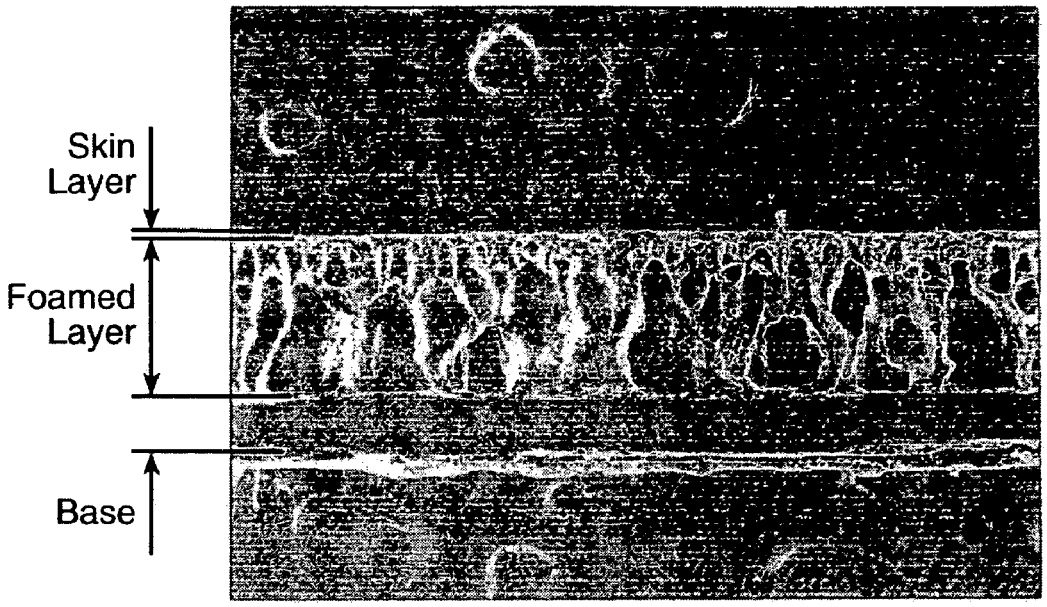
Figures 2, 2A:
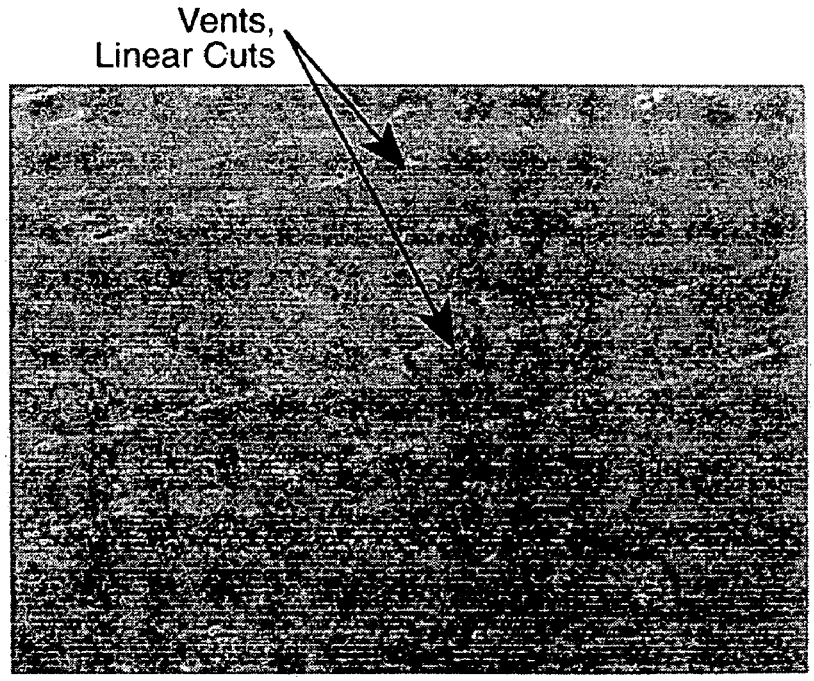
Figures 1, 2B:
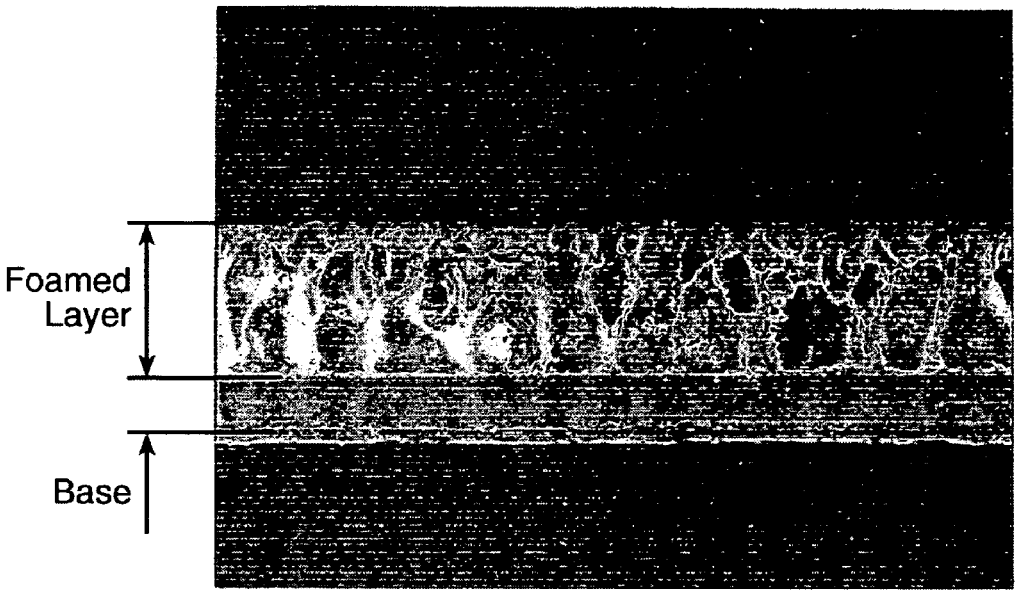
FIG. 2B-1 (PRIOR ART)
Figures 2, 2B:
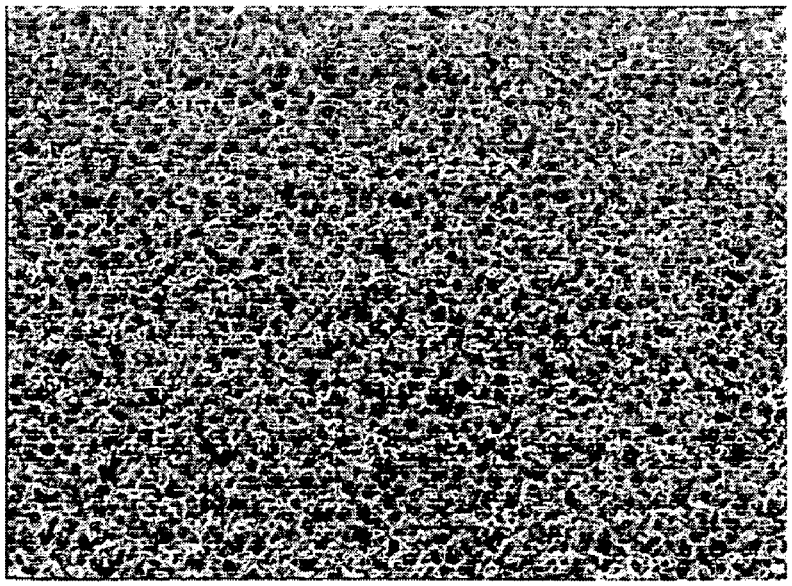
FIG. 2B-2 (PRIOR ART)

FIGS. 2A-1, 2A-2, 2B-1 and 2B-2 are microscopic photographs of a polishing cloth of this invention and a prior art polishing cloth for comparing their sectional views and their surfaces, FIGS. 2A-1 and 2A-2 showing sectional and plan views of a polishing cloth of this invention and FIGS. 2B-1 and 2B-2 showing sectional and plan views of a prior art polishing cloth produced by forming a foamed layer on a base and then buffing the surface so as to expose air bubbles. A comparison between FIGS. 2A-1 and 2B-1 shows that a skin layer is formed at the top of the polishing cloth of this invention but that there is no skin layer on the prior art polishing cloth. A comparison between FIGS. 2A-2 and 2B-2 shows that the surface of the polishing cloth embodying this invention is very flat and smooth, having hardly any protrusions or indentations but that the surface of the prior art polishing cloth has air bubbles exposed and is significantly bumpy.

A method of producing the polishing cloth 1 according to this invention includes the step of applying a foaming paint (or coating material) comprising a foaming resin on the surface of a base material. The foaming paint to be used according to this invention may preferably comprise foaming polyurethane resin (or polyurethane foam). This foaming polyurethane resin may preferably be formed by dissolving a mixture of organic diisocyanate, polyoles and a chain-elongating agent in a solvent and, if necessary, adding an additive such as a foaming agent and a foam improving agent. Examples of organic diisocyanate include diphenylmethane-4,4'-diisocyante and toolylene-2. Examples of polyole include polyester polyoles such as polyethylene adipate glycol, polypropylene adipate glycol and polyethylenepropylene adipate glycol, and polyether polyoles such as polyethylene ether glycol. Examples of chain-elongating agent include glycols such as ethylene glycol and propylene glycol, diamines such as ethylene diamine and trimethylene diamine, and amino-alcohol. Examples of solvent include water-miscible dimethyl formaldehyde, dimethyl sulfoxide, tetrahydro furan, dimethyl acetoamide, ethyl acetate and dioxane. Examples of compounding agent include water, fleon, silicone oil, vinyl polychloride, polyamides and polyacrylonitril. The foamable polyurethane resin may be coated by using an appropriate coating means such as a roll coater.

The method for producing a polishing cloth of this invention also includes the step of foaming the foamable coating material to form the surface layer. The foaming may be effected by a wet method or a dry method. If a wet method is used, the step of submerging in water for coagulation and thereafter washing and drying to remove the solvent is included.

The production method of this invention further includes the step of forming linear cuts on the surface of the skin layer. The linear cuts are formed by a buffing process but a different process may be employed for the purpose. The length of the linear cuts is controlled to be 10 μm or less. If an unwoven cloth is used as the base material, it is preferable to form the linear cuts after the surface of the foamable polyurethane resin is subjected to a thermal process, a press working process or a fine buffing process since the surface of the skin layer is not sufficiently flat and smooth.

Since the production method of this invention is an improvement over the prior art method for producing a prior art polishing cloth having externally exposed air bubble cells, a prior art production equipment may be employed without modifications. Thus, the number of production steps does not increase over the prior art method of production and there is no need for any extra equipment. In other words, there is no problem of an increase in the production cost or an additional space for equipment.

A comparison test was carried out between the polishing cloth of this invention and the prior art polishing cloth referenced with respect to FIGS. 2A-1, 2A-2, 2B-1 and 2B-2. A polishing liquid containing colloidal silica with average diameter of about 80 nm by about 5% (produced by Nihon Microcoating Co., Ltd) was used. Samples to be used for the polishing were prepared by polishing 3.5-inch aluminum substrates subjected to electroless NiP plating with a polishing pad (Politex DG pad produced by Rodel Co., Ltd.) by using a diluted liquid prepared by diluting a polishing liquid (DISKLITE3471 produced by Fujimi Incorporated) with pure water at the rate of 1:3. At this point of time, that is, before the test polishing, the surface roughness was 6-8 Å.

Table 1 shows other test conditions.

TABLE 1

| Polishing machine | Double-side polisher HAMAI-9BF (produced by Hamai Sangyo Kabushiki Kaisha) |
|---|---|
| Applied pressure | 90 g/cm$^2$ |
| Rotation of lapping plates | 40 rpm |
| Supply of polishing liquid | 0.2 liter/minute |
| Polishing time | 4 minutes |
| Stock removal | About 1 μm from both sides |

For measurements and evaluations, use was made of a scan-type white-color interferometer (New View 5000 produced by Zygo, Inc. with objective lens 10× and intermediate lens 0.8× and measurements taken within the wavelength range of 0.05-2 mm by filtering off wavelengths less than 0.05 mm and greater than 2.0 mm) to measure the average roughness Wa (in Å) as waviness.

Figure 3:
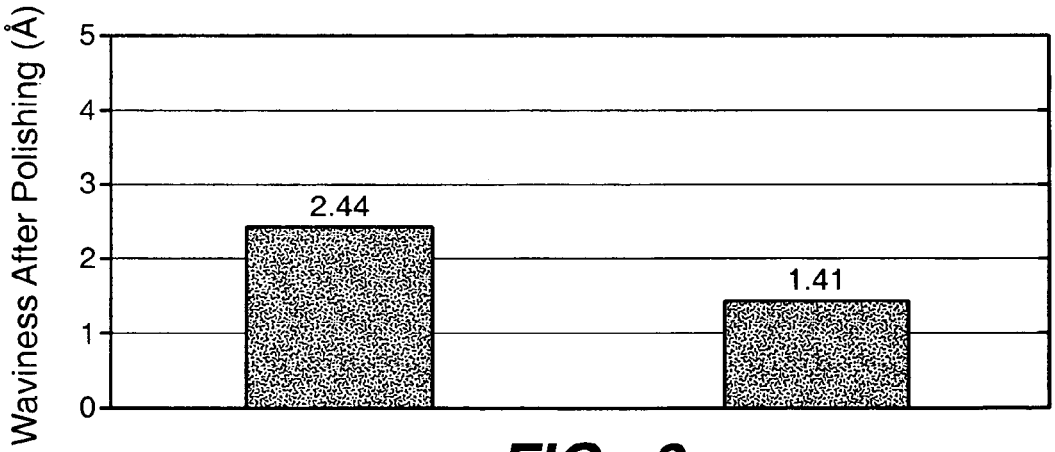
FIG. 3 (PRIOR ART)
FIG. 3 is a graph which shows the roughness of polished surfaces polished by a polishing cloth of this invention and a prior art polishing cloth.

FIG. 3 shows the measured waviness as the average from ten batches. The graph shows that the average Wa as waviness is 2.44 Å if a conventional polishing cloth is used but is only 1.41 Å if a polishing cloth of this invention is used. This represents an improvement by about 40% in the waviness. It has also been found that there was also a decrease in damage due to coagulated polishing agent and debris if a polishing cloth of this invention is used. It may be believed that this was because the linear cuts formed in the skin layer retain the polishing liquid to an appropriate degree while taking in debris of polishing.

What is claimed is:

1. A method of producing a polishing cloth, said polishing cloth comprising a base material and a surface layer stacked over said base material, said surface layer comprising a foamed layer and a non-foamed layer, said foamed layer including air bubble cells, said non-foamed layer having an externally exposed surface where linear cuts are formed, said linear cuts reaching said air bubble cells whereby said air bubble cells communicate to the exterior through said linear cuts, said method comprising the steps of:

applying a foamable coating material comprising a foamable resin over a surface of said base material;

foaming said foamable coating material to thereby form said surface layer; and forming said linear cuts through said non-foamed layer.

2. The method of claim 1 wherein said linear cuts are formed by a buffing process so as to be 10 μm or less in length.

* * * * *